United States Patent [19]

Petersen

[11] 4,295,597

[45] Oct. 20, 1981

[54] TRAY BLANK FOR EGGS

[75] Inventor: Jorgen N. Petersen, Lyngby, Denmark

[73] Assignee: Aktieselskabet Brødrene Hartmann, Lyngby, Denmark

[21] Appl. No.: 837,533

[22] Filed: Sep. 28, 1977

Related U.S. Application Data

[63] Continuation of Ser. No. 624,965, Oct. 22, 1975, abandoned.

[30] Foreign Application Priority Data

Jan. 27, 1975 [DK] Denmark ..... 25219/75

[51] Int. Cl.[3] ..... B65D 1/24; B65D 85/32

[52] U.S. Cl. ..... 229/2.5 EC; 229/44 EC; 217/26.5

[58] Field of Search ..... D9/184, 190; 217/26, 217/53, 27, 28, 40; 229/2.5 EC, 44 E, 45 EC, 14 C

[56] References Cited

U.S. PATENT DOCUMENTS

| | | | |
|---|---|---|---|
| 1,929,945 | 10/1933 | Chaplin et al. | 217/26.5 |
| 2,885,136 | 5/1959 | Grant | 229/2.5 EC |
| 2,922,541 | 1/1960 | Martelli et al. | 217/27 |
| 3,191,844 | 6/1965 | Comstock | D9/190 |
| 3,207,409 | 9/1965 | Reifers et al. | 229/2.5 EC |
| 3,362,606 | 1/1968 | Trimble | 229/2.5 EC |
| 3,767,103 | 10/1973 | Reifers | 229/2.5 EC |
| 3,877,599 | 4/1975 | Morris | 217/26.5 |

*Primary Examiner*—Herbert F. Ross
*Attorney, Agent, or Firm*—Pennie & Edmonds

[57] ABSTRACT

The invention concerns a tray blank, especially for eggs, having one or more upwardly extending projections, the diameter of each of said projections decreases in the upward direction, the lateral wall of each projection together with other wall sections adjacent to the projection comprising walls defining cell-shaped, upwardly open compartments adjoining the projection and intended to receive eggs. The projection is formed with an open projection which is slit downwardly from the top, starting from the upper, free edge of the wall of the projection, the wall sections defined by the slits continuing downwardly into the cell-shaped compartments and are formed as resilient surfaces supporting the eggs.

5 Claims, 1 Drawing Figure

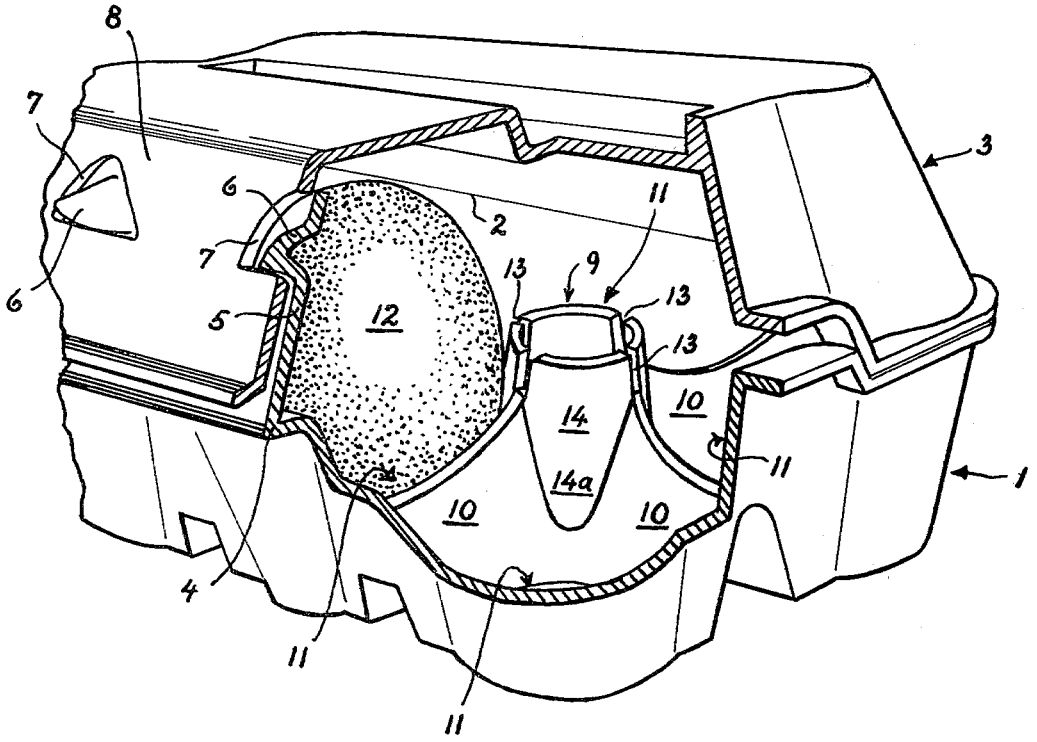
8
7
6
6
7
5
12
2
11
9
13
13
13
14
10
14a
10
10
11
3
1
4
11
11

TRAY BLANK FOR EGGS

This is a continuation of application Ser. No. 624,965 filed Oct. 22, 1975 now abandoned.

The invention relates to a tray blank, especially for eggs, having one or more upwardly extending projections, the diameter of of each of said projections decreases in the upward direction, the lateral wall of each projection together with other wall sections adjacent to the projections comprise walls defining cell-shaped, upwardly open compartments adjoining the projection and intended to receive eggs.

The invention has for its object to provide a tray blank of the kind heretofore indicated, which will support the eggs particularly carefully, whether they are slender or thick eggs.

According to the invention this object is achieved by the projection which is formed as an open projection which is slit at the top, the slits extending some distance downwardly, starting from the upper, free edge of the wall of the projection, and that the wall sections defined by the slits continue downwardly into the cell-shaped compartments and are formed as resilient surfaces supporting the eggs.

In this way supporting surfaces are provided which to a particularly high degree may yield to loads. The construction permits the supporting surfaces to be formed rather steeply without the resilience therefore being reduced. Consequently, slender as well as thick eggs will be firmly held. Slender eggs will be lodged rather far down between the resilient supporting surfaces, while thick eggs will make the supporting surfaces yield. The construction according to the invention is useful both for the production of egg trays with a large number of projections equidistantly placed in the longitudinal and the transverse direction of the tray, e.g. trays for 30 eggs, and for the production of egg cartons, of which the tray blank constitutes the lower part of the carton, which can be covered by means of a lid hinged thereto. In connection with egg cartons the use of a tray blank formed in accordance with the invention has the additional advantage that the interior of the carton will be ventilated through the slit, open end of the projection.

According to the invention it has proved sufficient that the distance between two slits corresponds to the width of the wall of the projection defining an adjacent compartment.

With a view to obtaining a particularly good resilience the lateral wall sections of the projection, defined by the slits, may according to the invention curve inwards toward the compartments.

According to the invention the slit portion of the projection may protrude above the level of the upper ends of the adjacent wall sections. In this way the wall sections located between the slits are made particularly resilient.

Finally, according to the invention the slits may lie in the same vertical plane as the upper edge of the adjacent wall sections. By this means a very expedient, construction of the tray blank is obtained.

The invention will now be explained in more detail, reference being had to the drawings which: The single FIGURE is an oblique depiction of a part of an egg carton, some parts of the carton having been cut away.

The shown egg carton consists of a lower part 1, a lid 3 hinged thereto by means of a hinge 2 formed along one of the long sides of the part 1, and a closing flap 5 hinged to the part 1 along the opposite side of said part by means of a hinge 4. In the drawing the carton is shown closed. In this condition the closing flap 5 lies within the lid 3, and locking projections 6 arranged on the closing flap protrude through apertures 7 formed in the lateral wall 8 of the lid 3 and thereby lock the lid 3 releasably to the lower part 1.

The lower part 1 of the carton is made up of a tray blank formed in conformity with the invention. The tray blank has a plurality of upwardly extending projections 9. The drawing shows one of these projections. The lateral wall of each projection 9 together with other wall sections 10 adjacent to the projection constitute walls defining cell-shaped, upwardly open compartments 11 adjoining the projection and intended to receive eggs 12.

The projection 9 is formed as a projection which is open at the top and slit by means of a number of slits 13 which extend some distance downwardly, starting from the upper, free edge of the wall of the projection. The wall sections 14 defined by the slits 13 continue downwardly into the cell-shaped compartments 11, as indicated at **14*a*, and are formed as resilient surfaces supporting the eggs 12**.

In the illustrated embodiments the distance between two slits 13 corresponds to the width of the wall of the projection defining an adjacent compartment 11. The lateral wall sections 14,**14*a*, defined by the slits 13, curve inwards toward the compartments 11. The slit portion 14 of the projection 9 protrudes above the level of the upper ends of the adjacent wall sections 10, and the slits 13 lie in the same vertical plane as the upper edge of the adjoining wall sections 10**.

I claim:

1. A tray blank especially for eggs comprising an egg carrier section and a cover, said carrier section having a plurality of egg-receiving compartments, each of said compartments being in part defined by a projection extending upwardly from the bottom of said carrier section, each projection having an open top, each projection having lateral wall portions, each lateral wall portion having an upper free edge at said open top, at least two slits in each projection, said slits extending downwardly from said upper free edge, said slits defining the lateral extent of said wall portions at and adjacent said upper free edge, each wall portion extending downwardly beyond said slits into a compartment, said wall portion being resilient due to the presence of said slits, said slits being free of engagement with said cover when said cover is in its closed position, said slits also being free when said cover is in its closed position to become reduced in size due to flexing of said wall portions, said wall portions in part defining an egg-receiving compartment only on one side of said wall portions, and the opposite side of said wall portions in part defining a space at all times free of eggs, whereby said wall portions may at all times give to support eggs of different sizes.

2. A tray blank according to claim 1 in which said slits are arranged in two planes arranged at substantially a right angle to each other.

3. A tray blank according to claim 1 in which said wall portion also curves inwardly toward the compartment to resiliently support an egg.

4. A tray blank according to claim 1 in which each compartment is also in part defined by additional walls, said additional walls being of lesser vertical extent than said projections.

5. A tray blank according to claim 4 in which said additional walls lie below said slits each in the same plane as its associated slit.

* * * * *